US005160916A

United States Patent [19]

Ishii et al.

[11] Patent Number: 5,160,916

[45] Date of Patent: Nov. 3, 1992

[54] IONIZATION TYPE SMOKE SENSOR

[75] Inventors: Kanji Ishii; Atsushi Nagai, both of Yokohama, Japan

[73] Assignee: Hochiki Kabushiki Kaisha, Tokyo, Japan

[21] Appl. No.: 631,351

[22] Filed: Dec. 20, 1990

[30] Foreign Application Priority Data

Dec. 25, 1989 [JP] Japan ..... 1-335320

[51] Int. Cl.[5] ..... G08B 17/10

[52] U.S. Cl. ..... 340/629; 340/628; 250/381

[58] Field of Search ..... 340/628, 629, 693; 250/381, 382, 384, 385.1

[56] References Cited

U.S. PATENT DOCUMENTS 4,328,424 5/1982 O'Conner ..... 340/629 X
4,336,455 6/1982 Bryant ..... 340/629 X
4,914,425 4/1990 Kaminaka et al. ..... 340/628
4,937,562 6/1990 Kaminaka et al. ..... 340/628

*Primary Examiner*—Jin F. Ng
*Assistant Examiner*—Jeffrey A. Hofsass
*Attorney, Agent, or Firm*—Max Fogiel

[57] ABSTRACT

An ionization-type smoke sensor having a 2-chamber 1-radiation source structure including an inner electrode having a radiation source, an intermediate electrode having an opening through which radiation from the radiation source passes, an outer electrode through which smoke may flow inside from outside, and an insulator supporting and insulating the inner electrode, the intermediate electrode and the outer electrode. In the sensor, a fence portion made of an insulating material is formed on and projecting from a surface of the insulator which faces the outer electrode, the fence portion surrounding the periphery of the opening of the intermediate electrode. By virtue of this arrangement, even when the sensor is subjected to flow of air heading from outside toward the opening of the intermediate electrode, the fence serves to reduce the flow of air heading toward the opening, thereby enabling the characteristics of the sensor chambers to remain stable against flow of air. Since the fence portion made of an insulating material is formed to project from the surface of the insulator, the creepage distance between the intermediate electrode and the outer electrode is long, thereby enabling an improved level of insulation for the electrodes.

4 Claims, 10 Drawing Sheets

PRIOR ART

PRIOR ART

IONIZATION TYPE SMOKE SENSOR

BACKGROUND OF THE INVENTION

1. Field of the Invention

The present invention relates to an ionization-type smoke sensor having a 2-chamber 1-radiation source structure which includes a radiation source employed to sense a change in the ion current caused by a change in the smoke concentration, and thereby detect a fire.

2. Related Art

For use in such an ionization-type smoke sensor where a 2-chamber 1-radiation source structure is adopted, the present inventors have previously proposed a structure of the electrode section of an ionization-type smoke sensor designed to be small and thin (Japanese Utility Model Registration Application No. 198631/1987). This sensor is shown in FIG. 9.

The ionization-type smoke sensor shown in FIG. 9 includes an inner electrode having a radiation source, an intermediate electrode having an opening through which radiation passes, and an outer electrode through which smoke can flow from the outside to the inside of the sensor. In the sensor, the inner electrode and the intermediate electrode define therebetween an inner chamber serving as a reference chamber where the interelectrode voltage is free from the influence of inflowing smoke and is always kept at a substantially constant level. The intermediate electrode and the outer electrode define therebetween an outer chamber where the interelectrode voltage changes in accordance with a change in the smoke concentration caused by an inflow of smoke from outside. An element having a high input impedance, such as an FET, is used to detect a change in the interelectrode voltage in the outer chamber upon an inflow of smoke, and, on the basis of the detection, the existence of smoke is determined. More specifically, as shown in FIG. 9, an inner electrode 1 is electrically connected, at an upper portion thereof, with a printed circuit board, not shown. A radiation source is disposed at a lower portion of the electrode 1. An intermediate electrode 2 is positioned axially outward (downward, as viewed in FIG. 9) of the inner electrode 1, with an inner chamber (inner ionization chamber) A being defined between the intermediate electrode 2 and the inner electrode 1. As specifically shown in FIG. 10, the intermediate electrode 2 is doughnut-shaped, and has an opening 3 through which radiation from the radiation source provided on the inner electrode 1 passes. The intermediate electrode 2 also has a single electrode member 4 extending toward the center of the opening 3.

Referring again to FIG. 9, an outer electrode 5, through which smoke can flow inside the sensor from the outside, is positioned axially outward of the intermediate electrode 2, with an outer chamber (outer ionization chamber) B being defined between the outer electrode 5 and the intermediate electrode 2. The inner electrode 1, the intermediate electrode 2 and the outer electrode 5 are all supported by an insulator 6 while also being insulated thereby.

With the ionization-type smoke sensor having the above-described construction, use of the doughnut-shaped intermediate electrode 2 provides the following advantages. The large opening 3 enables radiation to be efficiently projected into the outer chamber B, thereby enabling detection to be performed with increased sensitivity. Simultaneously, the electrode member 4 extending toward the center of the opening 3 enables the ionization current to be adjusted in such a manner as to prevent the characteristics of the inner chamber A from being influenced. In addition, the length of the electrode member 4 can be varied to easily vary the sensor characteristics.

In such an ionization-type smoke sensor, it is necessary that the characteristics of the ionization current within the chambers remain uninfluenced by and stable against inflow of air from the outside of the sensor.

However, in the above-described ionization type smoke sensor having the doughnut-shaped intermediate electrode, when, as shown in FIG. 9, air flows into the outer chamber B in directions towards the opening 3 of the intermediate electrode 2 from lateral or obliquely downward positions, that is, in such directions as those indicated by arrows K1', K2', K1 and K2, a phenomena such as convection occurs in the chambers, making the ionization current in the chambers unstable.

SUMMARY OF THE INVENTION

The present invention has been made in view of the above-described problem of the prior art. An object of the present invention is to provide an ionization-type smoke sensor capable of suppressing fluctuations in the characteristics of the ionization current in the chambers caused by air flowing into the outer chamber, the sensor thus being capable of providing stable operation.

In order to achieve the above-stated object, the present invention provides an ionization-type smoke sensor comprising: a printed circuit board 15 on which electrical parts are mounted; an inner electrode 1 electrically connected with the printed circuit board 15, the inner electrode 1 having a radiation source; an intermediate electrode 2 disposed axially outward of the inner electrode 1 in such a manner as to define, in cooperation with the inner electrode 1, an inner chamber A, the intermediate electrode 2 having an opening 3 through which radiation from the radiation source passes; an outer electrode 5 disposed axially outward of the intermediate electrode 2 in such a manner as to define, in cooperation with the intermediate electrode 2, an outer chamber B into which smoke may flow from outside; and an insulator 6 supporting and insulating the inner electrode 1, the intermediate electrode 2 and the outer electrode 5. Here, the above-listed constituent parts are accompanied by the respective reference numerals which are used in the drawings showing embodiments.

The present invention provides an ionization-type smoke sensor having such an electrode structure, the sensor further comprising a fence portion 22 formed on and projecting from a surface of the insulator 6 which faces the outer chamber B, in such a manner as to surroud the periphery of the opening 3 of the intermediate electrode 2, the fence portion 22 being made of an insulating material.

In the ionization-type smoke sensor according to the present invention having the above-described construction, the fence portion 22 projects to surround the periphery of the opening 3 of the intermediate electrode 2. By virtue of this arrangement, even when air, heading from the outside of the sensor toward the opening 3 of the intermediate electrode 2, flows from outside into the outer ionization chamber B, the fence 22 serves to reduce the flow of air heading toward the opening 3 of the intermediate electrode 2. Therefore, even in the event of inflow of air from the outside of the sensor, the characteristics of the ionization current in the chambers can remain stable.

In an embodiment of the present invention shown in FIG. 5, an ionization-type smoke sensor according to the present invention has a fence portion 22 provided as a separate member. This member is, as shown in the drawing, engaged with an engagement groove 30 formed on a surface of the insulator 6 which faces the outer chamber B, and is thus fixed to the surface. If the fence portion 22 is to be provided as a separate member, it is possible to prepare, for instance, a plurality of fence members 22 having different dimensions (heights) from the associated surface. In this case, it is possible to select, in accordance with the degree of possible inflow of air, a fence member 22 having a suitable height, and assemble the selected fence member. It is also possible to omit the fence portion 22 when the sensor is to be used at a location where no wind can blow into the sensor, so as to improve the efficiency of a smoke inflow.

In another embodiment shown in FIG. 6, an ionization-type smoke sensor according to the present invention has a fence portion comprising a plurality of fence members 22 which are concentrically provided and the height of which increases stepwise radially inward of the sensor. This arrangement assures that the flow of air which has entered the outer chamber B from the outside of the sensor is guided by the changes in the height of the fence members 22 in such a manner as to be deflected in directions away from the opening 3. Thus, it is possible to reduce the flow of air heading toward the opening 3.

In still another embodiment shown in FIG. 7, an ionization-type smoke sensor according to the present invention has a fence portion 22 whose distal end portion is inclined radially inward of the sensor. This arrangement also assures that, similarly to the arrangement described above, the flow of air is guided in directions away from the opening 3.

In a further embodiment shown in FIGS. 8 (*a*) and 8 (*b*), an ionization-type smoke sensor according to the present invention has a mesh-like fence portion 22. In this case, since the size of mesh holes 42 is much greater than the size of smoke particles, it is possible to prevent inflow of air without hindering an inflow of smoke.

In the ionization-type smoke sensor according to the present invention, the fence portion 22 made of an insulating material is projectingly formed on the insulator 6. Therefore, the creepage distance between the intermediate electrode 2 and the outer electrode 5 is long, thereby making it possible to improve the level of insulation for the electrode.

BRIEF DESCRIPTION OF THE DRAWINGS

FIG. 8 (*b*) is a fregmentary enlarged view showing the structure of a fence portion of the sensor shown in FIG. 8 (*a*);

THE PREFERRED EMBODIMENTS OF THE INVENTION

Figure 1:
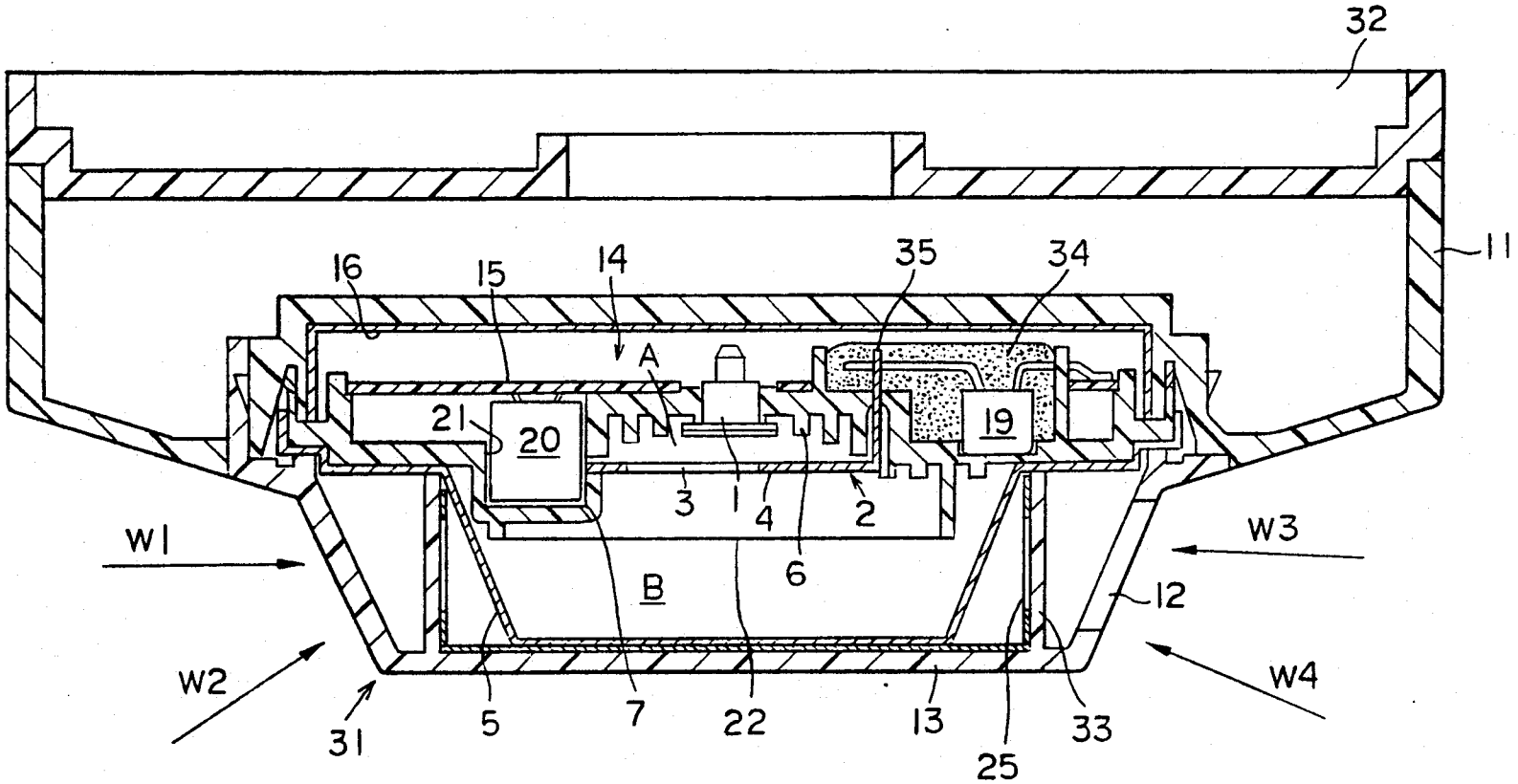
FIG. 1 is a sectional view of an ionization-type smoke sensor according to a first embodiment of the present invention.

FIG. 1 is a sectional view of an ionization-type smoke sensor according to one embodiment of the present invention.

Referring to FIG. 1, the sensor mainly comprises a main body 31 and a sensor base 32. While the sensor base 32 is arranged on and fixed to a place such as a ceiling surface, the main body 31 of the sensor is detachably mounted on the sensor base 32.

The main body 31 includes a main body cover 11. An outer cover 13 having a plurality of smoke inlets 12 is mounted to a lower portion of the cover 11. The outer cover 13 is formed into a cup-shape which opens upward, with the plurality of smoke inlets 12 being formed through an inclined peripheral side wall of the cover 13 which is inclined obliquely upward (as viewed in the figure). The smoke inlets 12 are formed into a substantially rectangular shape, and are arranged at certain intervals.

The outer cover 13 is integral with a cylindrical partition wall 33 which axially (vertically, as viewed in the figure) projects on the inside of the inclined peripheral side wall of the cover 13 where the smoke inlets 12 open. The partition wall 33 also has a plurality of substantially-rectangular smoke inlets (not shown in FIG. 1) which are formed through the periphery of the wall 33 and are arranged thereon to open at certain intervals.

The interior of the main body cover 11 which is covered with the outer cover 13 is partitioned by an insulator 6 into an upper, circuit accommodating section 14 and a lower, electrode section. The circuit accommodating section 14 accommodates a printed circuit board 15 on which electrical parts are mounted, as well as a shield case 16 suitably mounted in the section 14.

The upper section 14 includes an FET accommodating subsection 34 on an axially inward surface of the insulator 6. In this sub-section 34, an FET 19 and an electrode lead 35 of an intermediate electrode 2, described later, are insulation sealed by potting where a hot-melt resin, such as a synthetic resin hot melt, is charged. This serves to positively prevent breakdown by static electricity upon contact with hand during assembly or the like. In this embodiment, the FET 19 comprises a junction FET.

Positioned below the insulator 6 is the electrode section where an inner electrode 1, an intermediate electrode 2 and an outer electrode 5 are provided. More specifically, the inner electrode 1 is fitted through a central bore of the insulator 6, and is electrically connected, at an upper portion thereof, to the printed circuit board 15. The inner electrode 1 has a radiation source provided on a lower end portion thereof. At a position axially outward of the inner electrode 1, the intermediate electrode 2 is supported by the insulator 6, and is thus mounted.

Figure 2:
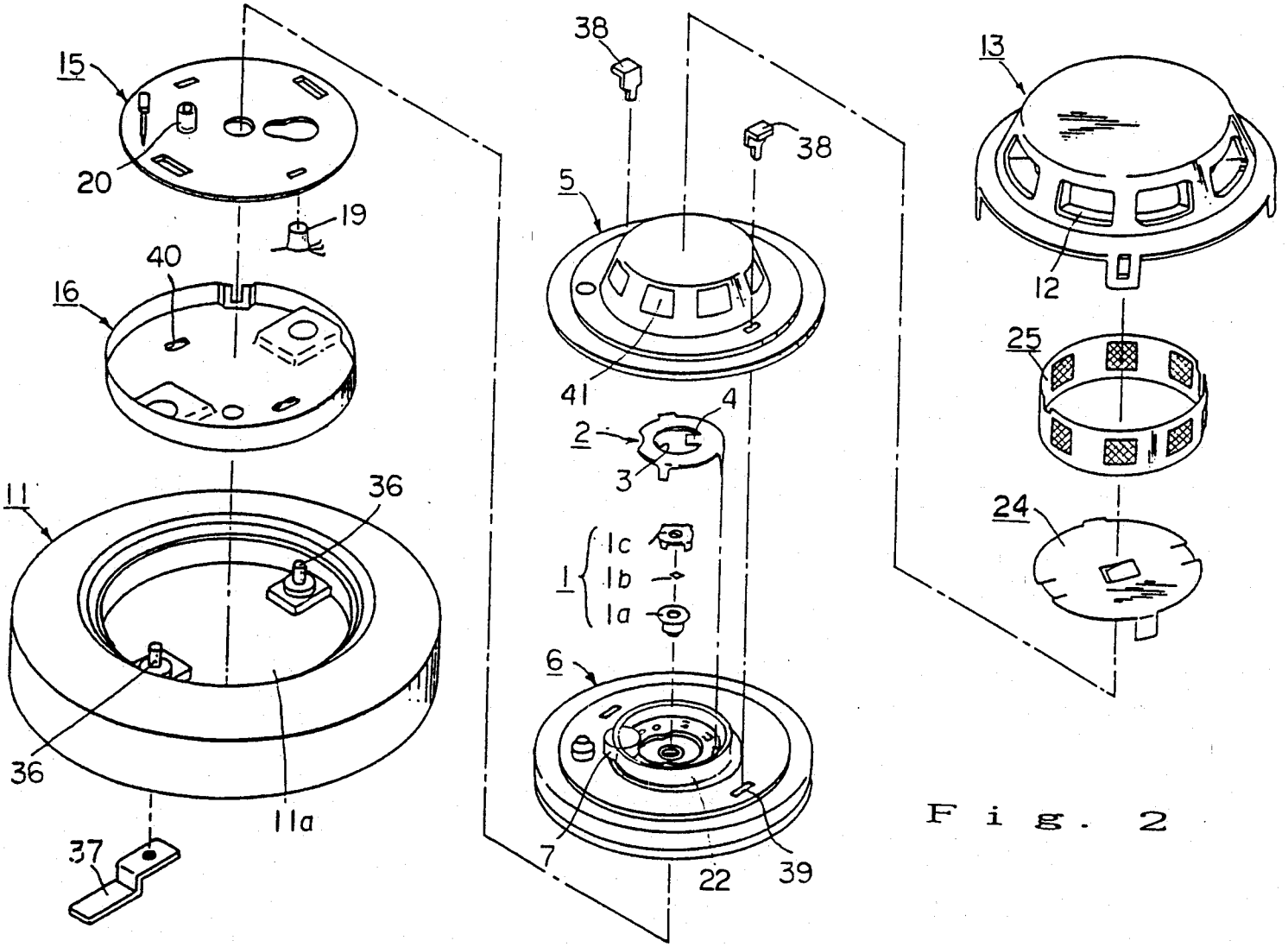
FIG. 2 is an exploded view of the sensor shown in FIG. 1.

The intermediate electrode 2 is, as specifically shown in FIG. 2, doughnut-shaped, and it has an opening 3 through which radiation from the radiation source provided on the inner electrode 1 passes. The intermediate electrode 2 also has a single electrode member 4 extending toward the center of the opening 3.

Referring again to FIG. 1, at a position axially outward of the intermediate electrode 2, the outer electrode 5 through which smoke can flow inside from outside is provided. An inner chamber A is defined between the inner electrode 1 and the intermediate electrode 2, while an outer chamber B is defined between the intermediate electrode 2 and the outer electrode 5.

The ionization-type smoke sensor according to this embodiment of the present invention further comprises an annular fence portion 22 which is integral with the insulator 6. The fence portion 22 projects on a surface of the insulator 6 which faces the outer chamber B, in such a manner as to surround the periphery of the opening 3 of the intermediate electrode 2.

A sub-section 21 accommodating a capacitor 20 axially protrudes at a position on the circumference of the fence portion 22 so that a part of the fence portion 22 is formed by a wall of the capacitor accommodating sub-section 21.

FIG. 2 is an exploded view of the embodiment shown in FIG. 1, which is useful to the understanding of assembly.

Referring to FIG. 2, the main body cover 11 has an opening 11*a* through which the shield plate 16 and the printed circuit board 15 are assembled in the mentioned order, with electrical parts such as the FET 19 and the capacitor 20 being mounted on the printed circuit board 15.

Two contact pins 36 for electrical contact with the printed circuit board 15 are provided at two positions on the inner wall of the opening 11*a*. Two engagement terminals 37 for engagement and connection with the sensor base 32 are fixed to the contact pins 36 and at the ends of the pins 36 which are remote from the board 15.

Following the assembly of the printed circuit board 15, the insulator 6 is assembled. On the surface of the insulator 6 which is to face the outer chamber B, the annular fence portion 22 projects, with a protrusion resulting from the forming of the capacitor accommodating sub-section 21 on that surface being positioned on the circumference of the fence portion 22.

The inner electrode 1, which is an assembly comprising a main body 1*a* of the electrode, a radiation source 1*b* and an electrode cover 1*c*, is fitted into the central bore of the insulator 6. Then, the doughnut-shaped intermediate electrode 2, having the electrode member 4 extending toward the opening 3, is assembled. Finally, the outer electrode 5, having a plurality of smoke inlets 41 on its peripheral side wall, is assembled.

Specifically, the outer electrode 5 is mounted by inserting contact metal members 38 through slits 39 of the insulator 6 until the leading ends of the contact metal members 38 are, through the printed circuit board 15, brought into contact with contact portions 40 of the shield plate 16. Those portions of the contact metal members 38 at which they pass through the printed circuit board 15 are soldered with ground portions of the board 15. Thus, the contact metal members 38 have both the function of mounting the outer electrode 5 to the insulator 6 and the function of shielding, in cooperation with the shield plate 16, the section where the printed circuit board 15 is accommodated.

The assembly of the outer electrode 5 is followed by the assembly of a base plate 24 and an insect proof net 25. Finally, the outer cover 13 having the smoke inlets 12 are assembled.

Next, the operation of the embodiment will be described.

It is assumed that, in FIG. 1, air flows toward the sensor in lateral directions indicated by arrows W1 and W3. In this case, the air flows into the outer chamber B through the smoke inlets formed on the peripheral side walls of the outer cover 13 and the outer electrode 5. However, the flow of air is blocked by the fence portion 22, and is thus prevented from flowing into the inner chamber A through the opening 3 of the intermediate electrode 2. As a result, the ion current in the inner chamber A is not distrubed by the flow of air but remains stable.

In the case where the sensor is subjected to air flowing from obliquely downward positions, i.e., flowing in the directions indicated by arrows W2 and W4, the flow of air is blocked by the fence portion 22 in a similar manner, thereby preventing the air from directly flowing into the inner chamber A. Therefore, the ion current in the inner chamber A remains stable.

Figure 3:
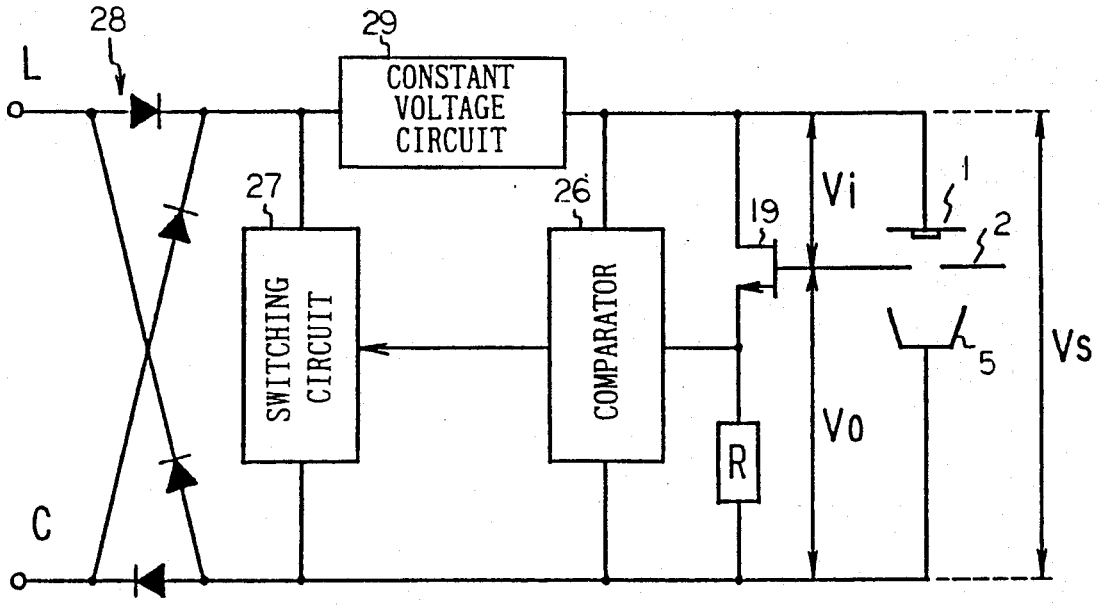
FIG. 3 is a circuit diagram showing the basic circuit-arrangement of electrodes of the sensor shown in FIG. 1 and an output circuit.

FIG. 3 shows the circuit arrangement of the ionization-type smoke sensor according to the present invention. The sensor includes the FET 19 and a resistor R by which the sensor monitors changes in the potential of the intermediate electrode 2. A potential of the intermediate electrode 2 resulting from an inflow of smoke is detected by the FET 19, then input to a comparator 26. A switching circuit 27 is actuated when, for instance, the detected voltage is above a predetermined threshold voltage, so that a receiver can be supplied with alarm current. The sensor also includes a diode bridge 28 for non-polarizing the connection polarity of the sensor, and a constant voltage circuit 29.

Figure 4:
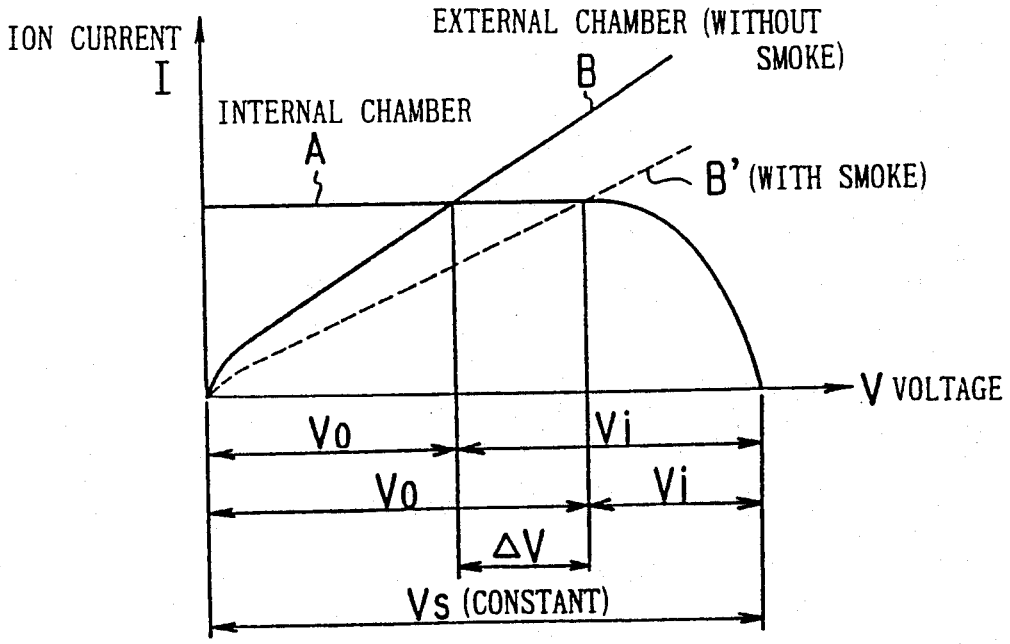
FIG. 4 is a graph showing the detection characteristics of the sensor shown in FIG. 1.

FIG. 4 shows the principles of the operation of the ionization-type smoke sensor according to the present invention. In the sensor, the ion current in the inner chamber A is kept constant relative to the voltage V applied. On the other hand, the ion current in the outer chamber B is such that, when no smoke flows into the chamber B, the ion current in this chamber changes in the manner indicated by solid line B in the figure, whereas when smoke does flow into the chamber B, the ion current in the chamber B changes as indicated by broken line B', that is, decreases. As a result, the potential of the intermediate electrode 2 increases by an amount corresponding to the voltage difference DV. On the basis of the increase in the potential of the intermediate electrode 2, a fire is detected.

Because the sensor operates in this way, in order to assure stable operation of the sensor, it is necessary that the ion current of the inner chamber A, which serves as the reference, be maintained at a constant level. This requirement is met in the present invention by providing the fence portion 22 so that, even when the sensor is subjected to an inflow of air from outside, the ion current in the inner chamber A is prevented from becoming unstable. It is therefore possible to positively prevent erroneous operation due to inflow of air.

In addition, since the fence 22 which is made of the same insulating material as the insulator 6 is projectingly formed, the forming of the fence 22 results in a corresponding increase in the creepage distance between the outer electrode 5 and the intermediate electrode 2. As a result, it is possible to improve the level of insulation between the electrodes.

Figure 5:
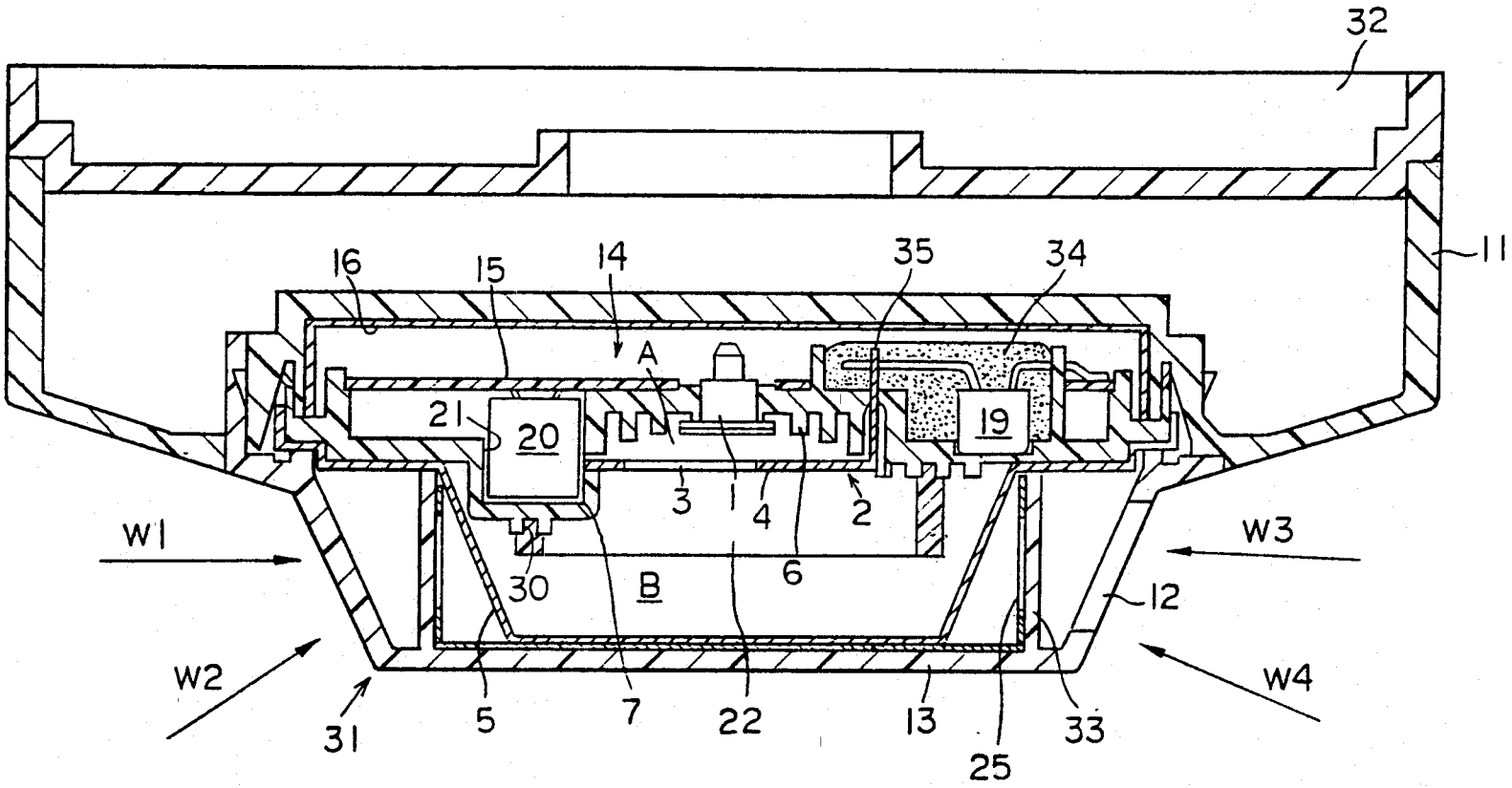
FIG. 5 is a sectional view of an ionization-type smoke sensor according to a second embodiment of the present invention.

FIG. 5 shows, in a section, a second embodiment of the present invention. The second embodiment is distinguished from the first embodiment in that the fence portion 22 is provided as a separate member. The separate member is, as shown in the figure, engaged with an engagement groove 30 formed on the surface of the insulator 6 which faces the outer chamber B, and is thus fixed to the surface.

If the fence portion 22 is provided as such a separate member, it is possible, for instance, to prepare a plurality of fence members 22 having different heights. In this case, one of the prepared members which has a suitable height is selected in accordance with the degree of possible inflow of air, and the selected fence member is assembled.

It is also possible to omit the fence portion 22 when the sensor is to be used at a location where no wind would possibly blow into the sensor. This makes it possible to improve the efficiency of a smoke inflow when such occurs.

Figure 6:
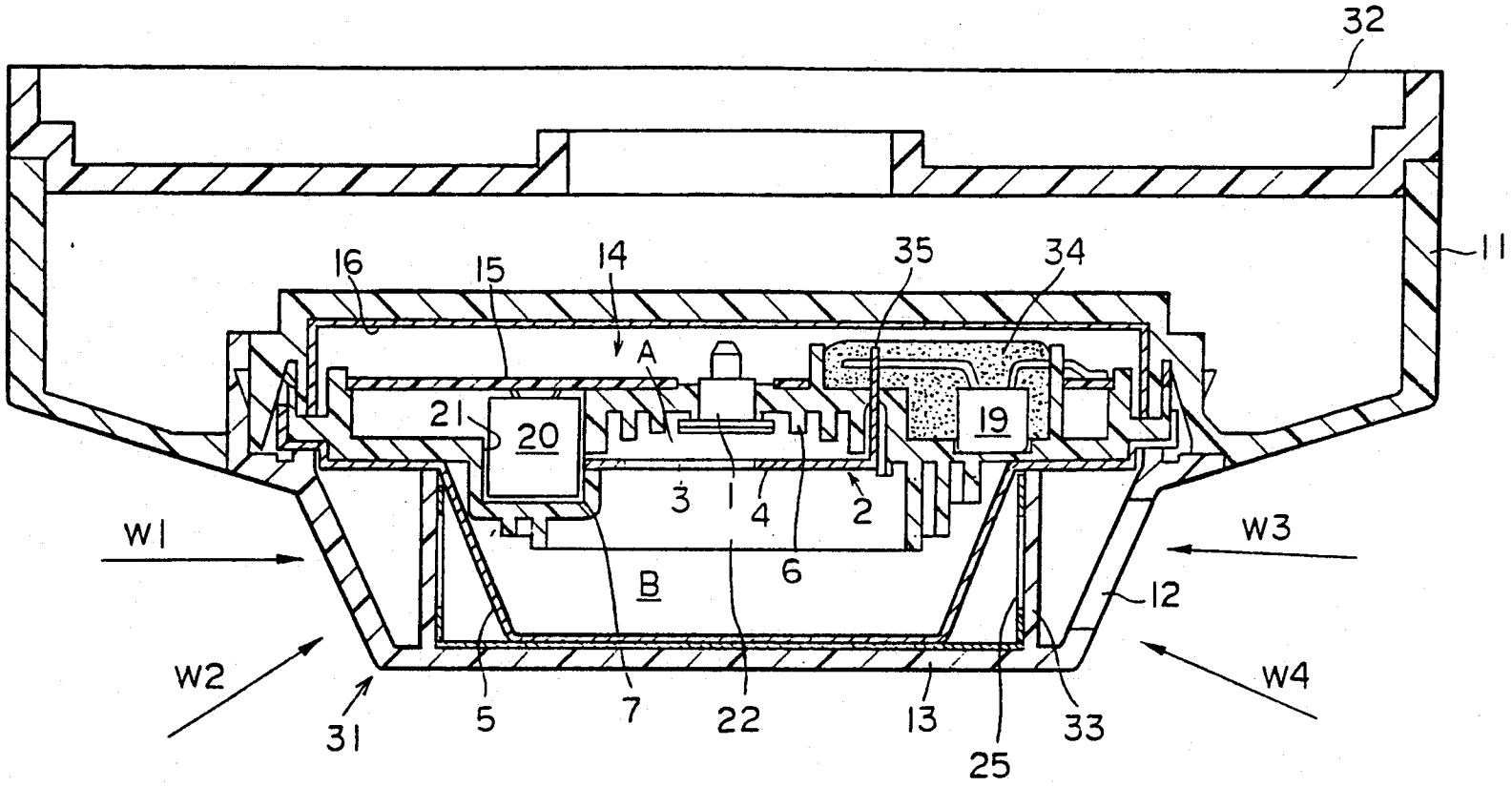
FIG. 6 is a sectional view of an ionization-type smoke sensor according to a third embodiment of the present invention.

FIG. 6 shows a third embodiment of the present invention. In the third embodiment, a plurality of fence members 22 are concentrically provided, with the respective heights of the members 22 being increased stepwise radially inward of the sensor.

This arrangement is advantageous in that the flow of air which has entered the outer chamber B from the outside of the sensor is guided by the changes in the height of the fence members 22 to be deflected in directions away from the opening 3. As a result, the flow of air heading toward the opening is reduced.

Figure 7:
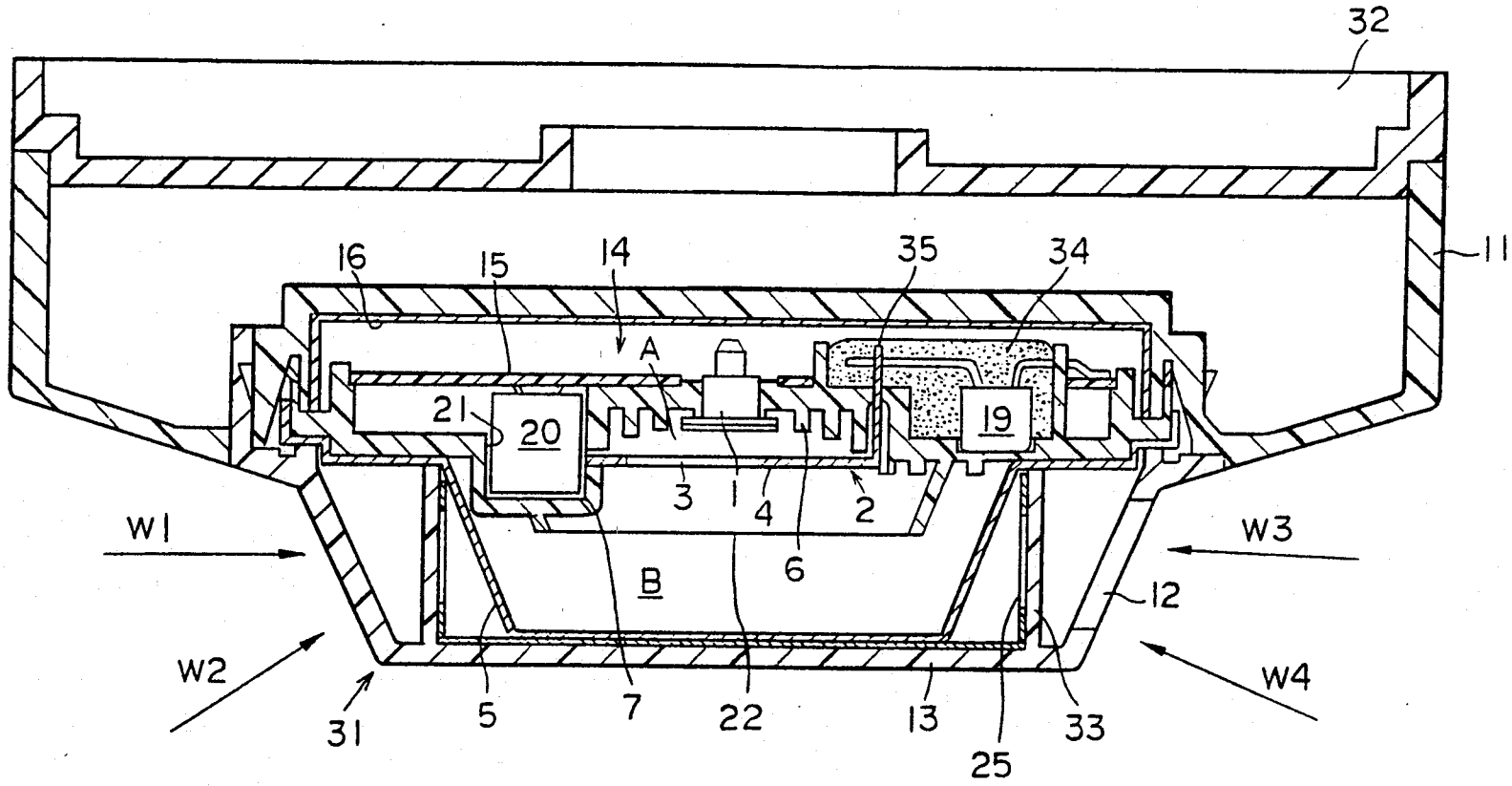
FIG. 7 is a sectional view of an ionization-type smoke sensor according to a fourth embodiment of the present invention.

FIG. 7 shows a fourth embodiment of the present invention. The fourth embodiment is distinguished in that the distal end portion of the fence portion 22 is inclined radially inward of the sensor. This arrangement provides an advantage similar to that described above, i.e., the guiding of the flow of air in directions away from the opening 3.

Figure 8:
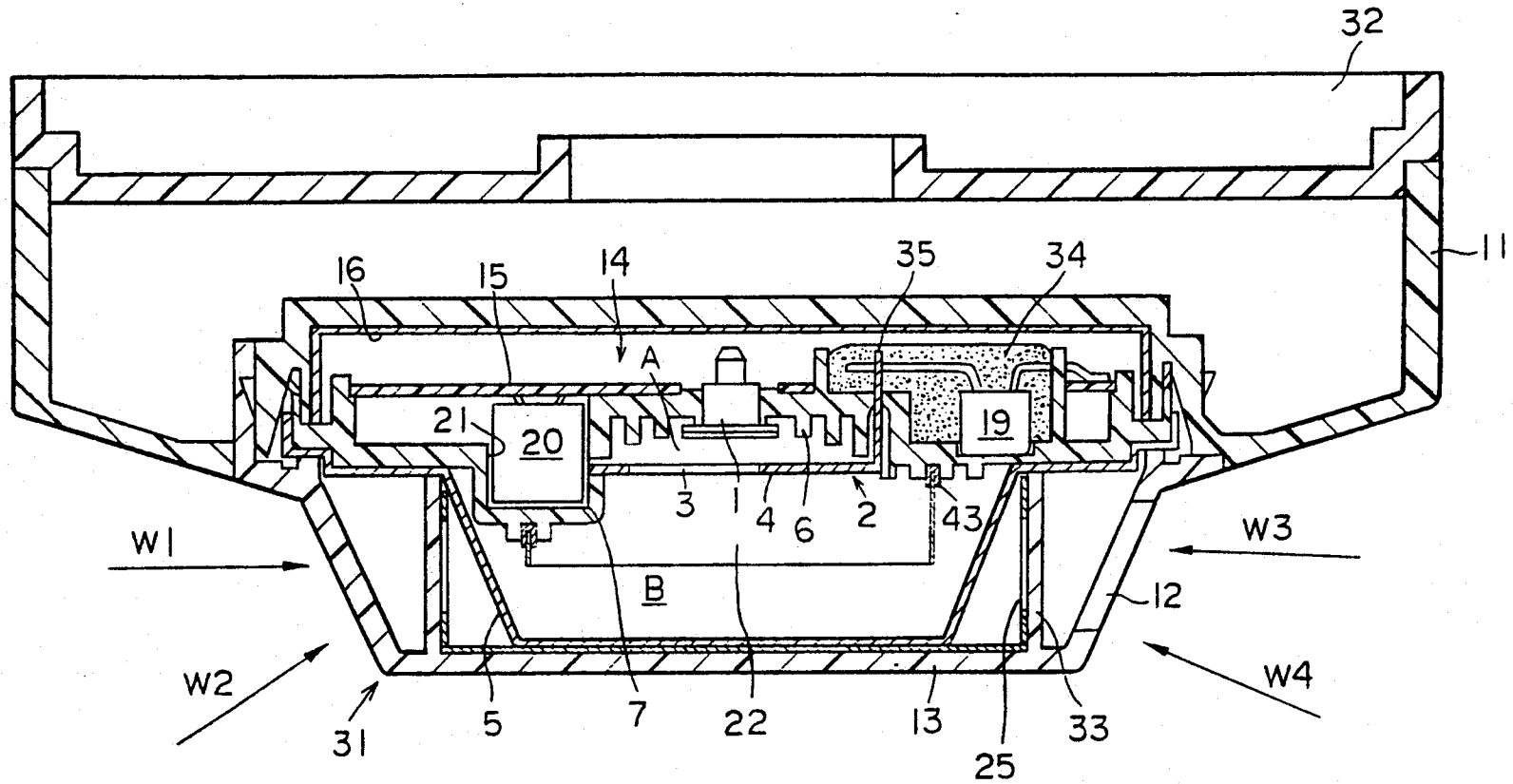
FIG. 8 (*a*) is a sectional view of an ionization-type smoke sensor according to a fifth embodiment of the present invention.
Figure 8B:
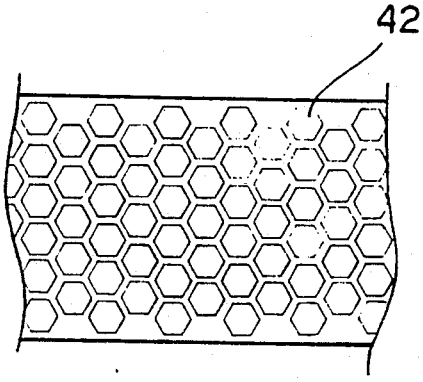
Figure 9:
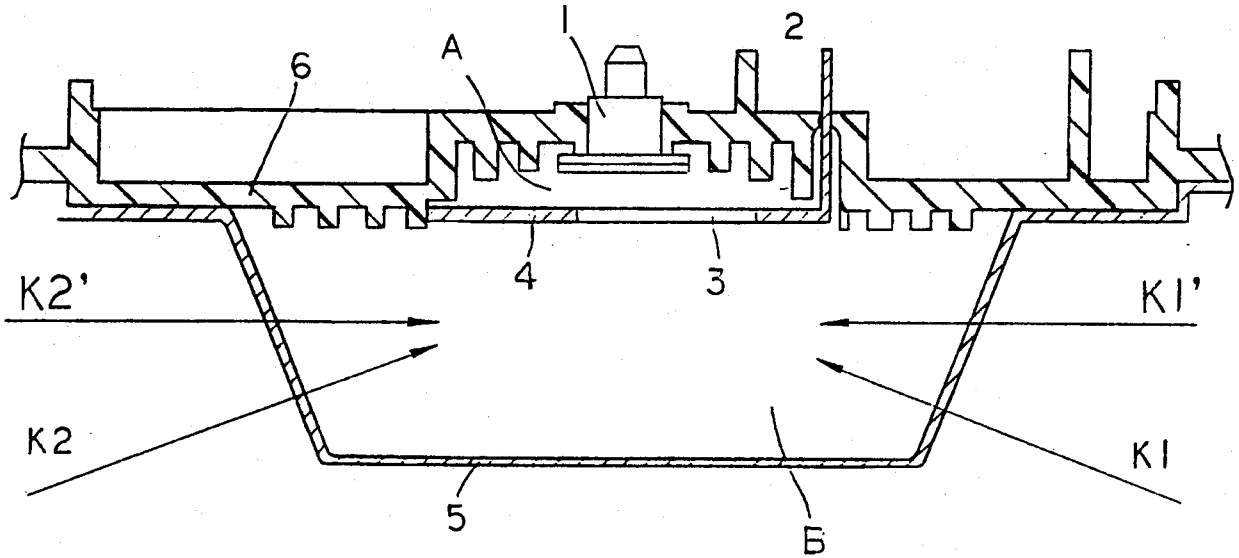
FIG. 9 is a fragmentary sectional view of a conventional ionization-type smoke sensor, showing the electrode structure thereof.
Figure 10:
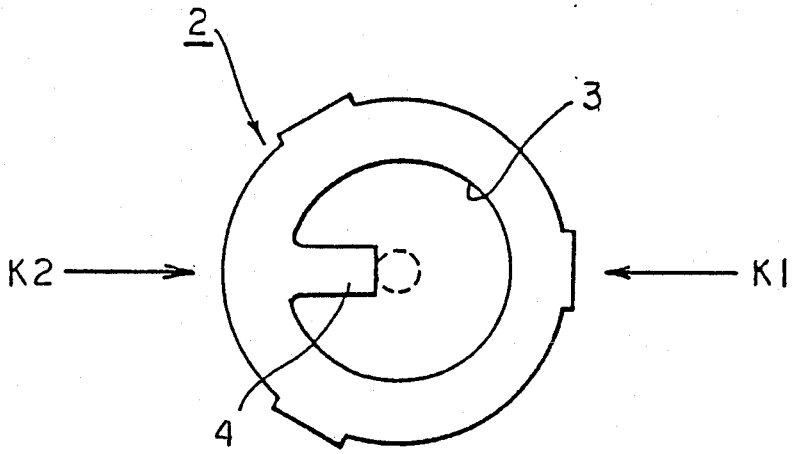
FIG. 10 is an explanatory view showing an intermediate electrode of the conventional sensor.

FIG. 8 (*a*) shows a fifth embodiment of the present invention. The fifth embodiment includes a fence portion 22 which is, as shown in FIG. 8 (*b*), mesh-like, and which is secured to the insulator 6 by a support member 43. The size of mesh holes 42 of the fence portion 22 is greater than the size of smoke particles. Therefore, the mesh-like fence portion 22 allows the passage therethrough of smoke particles, but blocks the inflow of air.

What is claimed is:

1. An ionization-type smoke sensor comprising: a printed circuit board with electrical parts mounted thereon; an inner electrode electrically connected with said printed circuit board, said inner electrode having a radiation source; an intermediate electrode disposed axially outward of said inner electrode and defining an inner ionization chamber in cooperation with said inner electrode, said intermediate electrode having an opening through which radiation from said radiation source passes; an outer electrode disposed axially outward of said intermediate electrode and defining an outer ionization chamber in cooperation with said intermediate electrode, smoke from outside being flowable into said outer ionization chamber; and an insulator supporting and insulating said inner electrode, said intermediate electrode and said outer electrode, said ionization-type smoke sensor comprising further a fence portion formed on and projecting from a surface of said insulator facing said outer ionization chamber and surrounding the periphery of said opening of said intermediate electrode, said fence portion being made of an insulating material; said fence portion comprising a plurality of concentric fence members having a height increasing stepwise radially inward toward the center of said sensor.

2. An ionization-type smoke sensor according to claim 1, wherein said insulator is integral with said fence portion.

3. An ionization-type smoke sensor according to claim 1, wherein said fence portion is inclined radially inward toward the center of said sensor.

4. An ionization-type smoke sensor according to claim 1, wherein said fence portion is mesh-like.

* * * * *